US009777428B2

(12) United States Patent
Kim et al.

(10) Patent No.: US 9,777,428 B2
(45) Date of Patent: Oct. 3, 2017

(54) OPERATING METHOD FOR CLOTHES TREATING APPARATUS

(75) Inventors: Minji Kim, Gyeongsangnam-Do (KR); Hyojin Ko, Gyeongsangnam-Do (KR); Taegyu Jin, Gyeongsangnam-Do (KR); Sanghun Bae, Gyeongsangnam-Do (KR)

(73) Assignee: LG ELECTRONICS INC., Seoul (KR)

( * ) Notice: Subject to any disclaimer, the term of this patent is extended or adjusted under 35 U.S.C. 154(b) by 670 days.

(21) Appl. No.: 13/345,371

(22) Filed: Jan. 6, 2012

(65) Prior Publication Data

US 2012/0174430 A1 Jul. 12, 2012

(30) Foreign Application Priority Data

Jan. 10, 2011 (KR) ..... 10-2011-0002432

(51) Int. Cl.
*F26B 3/00* (2006.01)
*D06F 58/28* (2006.01)

(52) U.S. Cl.
CPC ..... *D06F 58/28* (2013.01); *D06F 2058/289* (2013.01); *D06F 2058/2816* (2013.01); *D06F 2058/2864* (2013.01); *D06F 2058/2896* (2013.01)

(58) Field of Classification Search
CPC .... D06F 2204/065; D06F 23/04; D06F 25/00; D06F 29/00; D06F 29/005; D06F 39/005; D06F 33/02; D06F 39/02; D06F 39/088; D06F 37/04; D06F 37/267; D06F 39/12; D06F 58/02; D06F 58/22; D06F 58/24; D06F 58/20
USPC ..... 34/428, 60; 324/106, 95, 99 R, 101, 120
See application file for complete search history.

(56) References Cited

U.S. PATENT DOCUMENTS

| | | | | |
|---|---|---|---|---|
| 3,247,690 | A * | 4/1966 | Kahn | D06F 43/02 68/143 |
| 3,409,994 | A * | 11/1968 | Menk | 34/499 |
| 7,506,458 | B2 * | 3/2009 | Lee et al. | 34/601 |
| 2002/0022811 | A1 * | 2/2002 | Kim | 604/347 |
| 2008/0043807 | A1 * | 2/2008 | Yazawa et al. | 374/141 |
| 2008/0184586 | A1 * | 8/2008 | Yoo et al. | 34/427 |
| 2009/0139212 | A1 * | 6/2009 | Miwa | 60/277 |
| 2009/0255299 | A1 * | 10/2009 | Hiro et al. | 68/19 |
| 2009/0320318 | A1 * | 12/2009 | Kim | D06F 35/00 34/428 |

(Continued)

FOREIGN PATENT DOCUMENTS

| | | | |
|---|---|---|---|
| CN | 1769572 | A | 5/2006 |
| CN | 101358426 | A | 2/2009 |

(Continued)

*Primary Examiner* — Jason Lau
(74) *Attorney, Agent, or Firm* — Birch, Stewart, Kolasch & Birch, LLP

(57) ABSTRACT

A method for operating a clothes treating apparatus comprising a hot air supplying unit provided with a heater and a blowing device, and having a drying function of drying clothes by supplying hot air into a drum by use of the hot air supplying unit, includes rotating the drum with the clothes introduced therein, and supplying hot air into the drum by using the heater and the blowing device while the drum is rotated, wherein an air flow rate supplied by the blowing device changes during the hot air supplying step.

6 Claims, 4 Drawing Sheets

(56) References Cited

U.S. PATENT DOCUMENTS

| | | | | |
|---|---|---|---|---|
| 2010/0024243 | A1* | 2/2010 | Ricklefs et al. | 34/474 |
| 2010/0126032 | A1* | 5/2010 | Kim et al. | 34/79 |
| 2010/0281924 | A1* | 11/2010 | Tobi et al. | 68/19 |

FOREIGN PATENT DOCUMENTS

| | | | |
|---|---|---|---|
| CN | 101473084 | A | 7/2009 |
| DE | 38 20 815 | A1 | 12/1989 |
| EP | 2 080 832 | A1 | 7/2009 |
| JP | 5-329298 | A | 12/1993 |
| JP | 9-084997 | A | 3/1997 |
| JP | 10-005497 | A | 1/1998 |
| JP | 2000-140493 | A | 5/2000 |
| JP | 2001 218994 | A | 8/2001 |
| KR | 10-2008-0032398 | A | 4/2008 |

* cited by examiner

OPERATING METHOD FOR CLOTHES TREATING APPARATUS

CROSS-REFERENCE TO RELATED APPLICATION

The present disclosure relates to subject matter contained in priority Korean Application No. 10-2011-0002432, filed on Jan. 10, 2011, which is herein expressly incorporated by reference in its entirety.

BACKGROUND OF THE INVENTION

1. Field of the Invention

This specification relates to an operating method for a clothes treating apparatus, and particularly, to an operating method for a clothes treating apparatus, capable of drying clothes by supplying hot air into a rotating drum.

2. Background of the Invention

In general, a clothes treating apparatus having a drying function, such as a washing machine or a clothes dryer, dries clothes (laundry) by putting the clothes, which are completely washed and dehydrated (spin-dried), into a drum, supplying hot air into the drum, and evaporating moisture of the clothes.

For example, a clothes dryer includes a drum rotatably installed in a main body and receiving laundry therein, a driving motor to drive the drum, a blowing fan to blow air into the drum, and a heating unit to heat air introduced into the drum. The heating unit may use thermal energy generated using electric resistance or heat of combustion generated by burning gas.

Meanwhile, in the related art dryer, as aforementioned, while drying clothes with supplying hot air into the drum, a humidity sensor mounted in the dryer is used to measure a content of moisture within the clothes. When the measured content of moisture is less than a predetermined level, it is determined as completion of the drying, thereby terminating the drying process. Here, since the introduced clothes are rotated along an inner wall of the drum in an entangled state in response to rotation of the drum during the drying process, there may exist an area without contact with hot air, which causes different dried levels for the clothes. Hence, a drying time should extend for drying the entire clothes, which may cause an increase in energy consumption and some clothes may excessively be dried.

In addition, if the clothes are dried in a stacked state with other clothes, generated wrinkles may be fixed without becoming smooth, resulting in generating excessive wrinkles.

SUMMARY OF THE INVENTION

Therefore, to address the drawbacks of the related art, an aspect of the detailed description is to provide a clothes treating apparatus capable of reducing a drying time and minimizing damages on the clothes by allowing for uniform drying of the clothes introduced.

Another aspect of the detailed description is to provide a clothes treating apparatus capable of minimizing generation of wrinkles, which may be generated due to friction between clothes and a drum during rotation of the drum.

To achieve these and other advantages and in accordance with the purpose of this specification, as embodied and broadly described herein, there is provided a method for operating a clothes treating apparatus including a hot air supplying unit provided with a heater and a blowing device, and having a drying function of drying clothes by supplying hot air into a drum by use of the hot air supplying unit, the method including rotating the drum with the clothes introduced into the drum, and supplying hot air into the drum by using the heater and the blowing device while the drum is rotated, wherein an air flow rate supplied by the blowing device changes during the hot air supplying step.

In one aspect of the present disclosure, an air flow rate that hot air is supplied may change intermittently or at a preset period while performing drying with supplying the hot air, thereby making the clothes moved more actively within the drum. That is, air pressure applied onto the clothes may change in response to an increase or decrease of the air flow rate, which may allow the entangled or pressed clothes to be free. Therefore, the clothes introduced into the drum may be uniformly dried and generation of wrinkles may be minimized.

Here, the hot air is not inevitably supplied. A case where only the blowing device runs with the heater off according to a dried level may be considered. Especially, at the last part of the drying in which the clothes are dried to some degree, if air is merely blown in with the heater off to allow the clothes to be dried at a relatively low temperature, it may be advantageous in the aspect of preventing the generation of wrinkles.

Meanwhile, the air flow rate supplied by the blowing device may change within a range between a first air flow rate and a second air flow rate higher than the first air flow rate. That is, the blowing device may be controlled to supply the first air flow rate and the second air flow rate, thereby simplifying a configuration of a controller.

Here, the air flow rate may change only when a moisture content within the clothes is less than a predetermined level. That is, at the beginning of the drying with a relatively large content of moisture, the clothes may be less affected by air pressure even if the air flow rate changes. Hence, the air flow rate can be decreased in a state that the weight of the clothes has been reduced as being dried to some degree, thereby reducing energy consumption and maximizing an effect by the variable air flow rate.

The hot air supplying step, namely, drying step may include a first drying step of increasing an inner temperature of the drum, a second drying step of constantly maintaining the inner temperature of the drum after the first drying step, and a third drying step of re-increasing the inner temperature of the drum after the second drying step.

The first drying step may be started right after the drying is initiated. In this step, the clothes contain a large content of moisture. Accordingly, even if hot air is blown in by the heater, the inner temperature of the drum relatively slowly increases.

The second drying step may follow the first drying step, and correspond to a section in which temperature is almost uniformly maintained by virtue of balancing between a quantity of heat supplied by the hot air and a quantity of heat adsorbed by moisture evaporated from the clothes by the supplied heat.

The third drying step may be a step in which the supplied quantity of heat starts to exceed the adsorbed quantity of heat due to the decrease of the moisture content contained in the clothes. In this step, when the quantity of heat generated from the heater is constantly maintained, the inner temperature of the drum may increase as a time elapses.

Therefore, when the air flow rate changes in the first drying step, an effect to some degree may be obtained. However, the weight of the clothes in the first drying step is heavier than the other steps, so it may not cause a great change in the movement of the clothes by the air pressure. Consequently, the air flow rate can change in the second or third drying step.

The air volume changing step in the third drying step may include increasing the air flow rate up to a second air flow rate, maintaining the second air flow rate for a preset time, and decreasing the air flow rate down to a first air flow rate. That is, the third step may be a process in which the drying is carried out to some degree and thus the inner temperate of the drum increases. Hence, a large air flow rate may be supplied to lower the temperature of hot air and make the clothes moved more actively, thereby more effectively preventing the generation of wrinkles.

Here, the air volume increasing, maintaining and decreasing steps may be repeated at preset time intervals. The rotating speed of the drum may be reduced when the air flow rate increases, namely, the second air flow rate is supplied, and the rotating speed of the drum may be recovered to the original state when the first air flow rate is supplied. That is, when the rotating speed of the drum is reduced during the supply of the large air flow rate to reduce a centrifugal force, the clothes can be more easily separated from the inner wall of the drum, thereby making the clothes moved more actively.

Meanwhile, the hot air supplying step may include measuring temperature of hot air exhausted from the drum, and increasing the air flow rate when the measured temperature of the exhausted air exceeds a predetermined temperature. That is, by measuring the temperature of air exhausted form the drum, the inner temperature of the drum can indirectly be measured, which may prevent the inner temperature of the drum from being excessively increased.

This may be measured based on a content of moisture contained in the clothes other than the temperature of the exhausted air. That is, when a moisture content is measured by an electrode sensor or the like disposed within the drum, the changes in the inner temperature of the drum may be indirectly judged. That is, when the moisture content is less than 7 to 10%, more wrinkles may be generated on the clothes due to friction between the clothes and the drum. Hence, when the moisture content measured is within the corresponding section, the air flow rate may increase to lower the inner temperature and reduce the friction between the clothes and the drum, thereby preventing the generation of wrinkles.

In addition to these, when the heater is configured to be blocked from power supply upon the increase in the inner temperature of the drum, a frequency of blocking power supplied into the heater may be measured so as to indirectly judge the changes in the inner temperature of the drum. Hence, the hot air supplying step may further include measuring a frequency of blocking the power supplied to the heater, and increasing the air flow rate when the measured blocking frequency is less than a predetermined level.

Meanwhile, the hot air supplying step may include accelerating/decelerating the rotating speed of the drum in an alternating manner. When the rotating speed of the drum is alternately accelerated/decelerated, the clothes pressed onto the inner wall of the drum may be free from the inner wall of the drum due to a drastic change in the centrifugal force. The thusly-separated clothes may be dropped onto the bottom surface of the drum, but they may be dropped after floating in the air for a while due to hot air supplied. Hence, the clothes may avoid friction against the drum as long as a time of floating in the air, which may result in prevention of wrinkle generation due to friction and damages on the clothes.

Here, the drum may be controlled to be rotated at a first speed for a preset time and then rotated at a second speed faster than the first speed for a preset time. The accelerating/decelerating step may be carried out when the moisture content of the clothes is less than a predetermined level or the inner temperature of the drum is more than a predetermined temperature.

In order to increase the floating time of the clothes in the air and realize a variety of movements of the clothes, a large air flow rate may be supplied during the accelerating/decelerating step as compared to the other steps.

In accordance with the aspects of the present disclosure having the configuration, an air flow rate that hot air is supplied may change intermittently or at a preset period during the drying process so as to make the clothes moved more actively within the drum, and accordingly make the entangled or pressed clothes free, thereby minimizing the generation of wrinkles. In addition, the clothes introduced into the drum can be uniformly dried.

Also, the supplied air flow rate may change not in a consecutive manner but in a sequential manner so as to simplify a configuration of a controller.

In addition, the rotating speed of the drum can be controlled to be accelerated/decelerated in the alternating manner while supplying the hot air, such that the clothes pressed onto the inner wall of the drum can be separated from the inner wall of the drum. The thusly-separated clothes may float in the air for a while due to the hot air supplied, thereby reducing a friction time against the drum.

Further, there is provided a method for operating a clothes treating apparatus comprising: drying the clothes by rotating the drum with the clothes introduced therein and supplying air into the drum while the drum is rotated; changing air flow rate into the drum in a certain time during drying; stopping the rotating the drum and supplying air when the clothes are dried to a pre-determined degree.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of a clothes treating apparatus according to the exemplary embodiment, with reference to the accompanying drawings. For the sake of brief description with reference to the drawings, the same or equivalent components will be provided with the same reference numbers, and description thereof will not be repeated.

Figure 1:
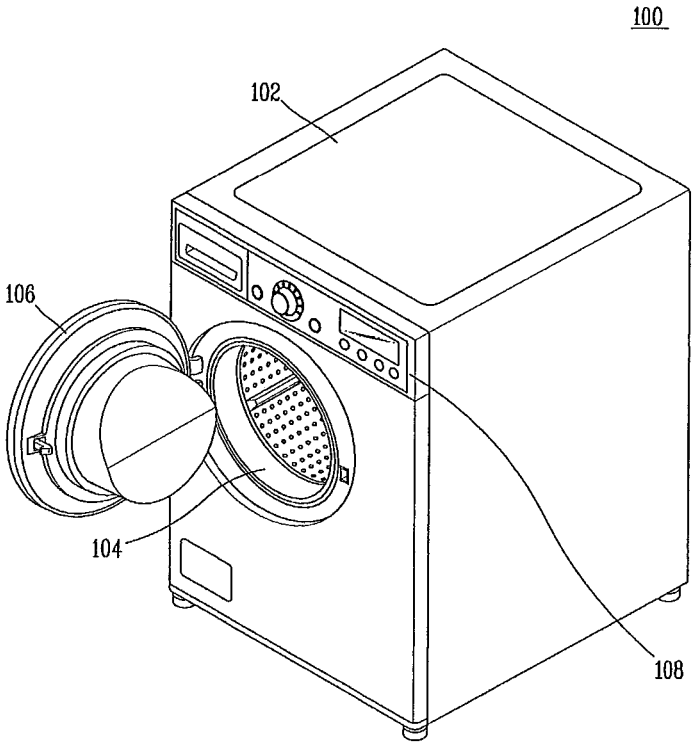
FIG. 1 is a perspective view schematically showing one exemplary embodiment of a clothes treating apparatus in accordance with this specification.

FIG. 1 is a perspective view schematically showing one exemplary embodiment of a clothes treating apparatus in accordance with this specification. The exemplary embodiment illustrates a dryer but the present invention may not be limited to the dryer. The present invention may also be applicable to any type of clothes treating apparatus, which is configured such that hot air is supplied to dry clothes and the used hot air is exhausted out of a drum.

As shown in FIG. 1, the dryer 100 may include a main body 102 defining an appearance of the apparatus. A front surface of the main body 102 may be shown having an introduction opening 104 through which clothes as targets to be dried are introduced into the main body 102. The introduction opening 104 may be open or closed by a door 106. A manipulation panel 108 having various manipulation buttons for manipulation of the dryer may be located above the introduction opening 104.

Figure 2:
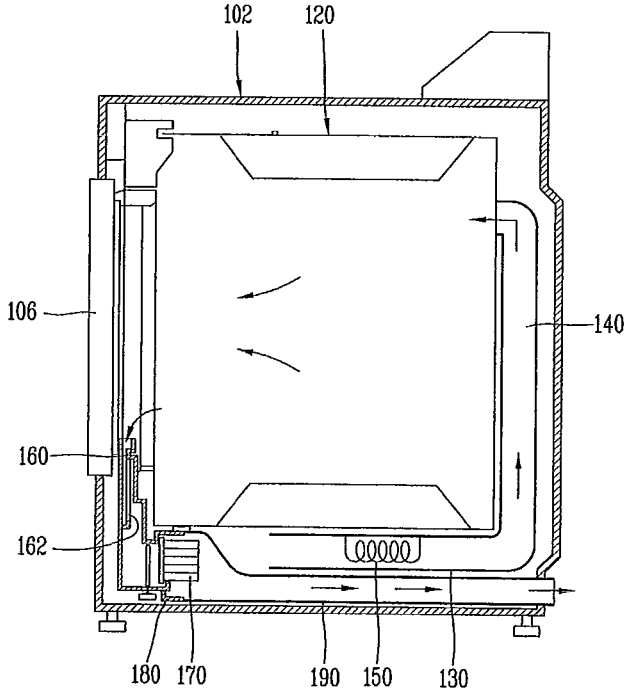
FIG. 2 is a sectional view schematically showing an inner structure in the exemplary embodiment of FIG. 1.
Figure 3:
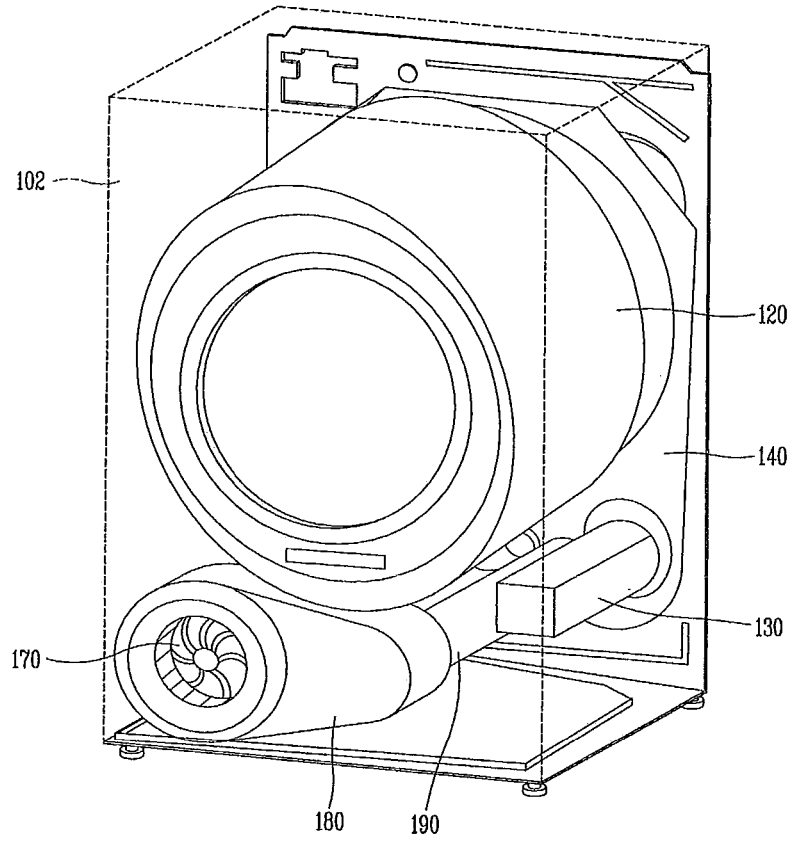
FIG. 3 is a perspective view schematically showing the inner structure of FIG. 1.

FIGS. 2 and 3 are a sectional view and a perspective view schematically showing an inner structure of the dryer 100. As shown in FIGS. 2 and 3, a drum 120 may be rotatably disposed within the main body 102 to dry clothes or targets to be dried therein. The drum 120 may be rotatably supported by supporters at front and rear sides thereof. The drum 120 may be connected to a power transfer belt (not shown) and a driving motor located at a lower portion of the dryer so as to be rotatable by receiving a rotational force.

A lower portion of the drum 120 may be shown having a first suction duct 130, and a second suction duct 140 installed at the rear of the first suction duct 130 in a longitudinal direction of the main body 102. The first and second suction ducts 130 and 140 may suck thereinto air, which is introduced from the exterior and present within the main body 102, and supply the sucked air into the drum 120. Here, air is supplied into the drum 120 via an inlet port (not shown) formed through the second suction duct 140. The inlet port may extend in a longitudinal direction based on a center of the drum 120 such that air can be introduced into the drum via an entire surface of the drum 120.

Besides, an example that the inlet port is formed at an upper or lower portion may be regarded.

A heater 150 may be installed within the first suction duct 130 so as to heat up introduced external air at a low temperature into air hot enough to dry the clothes. Also, although not shown, a moisture detecting sensor for measuring a content of moisture within the clothes introduced into the drum 120 may further be provided. Any type of sensor may be used as the moisture detecting sensor. As one example, an electrode sensor, which uses a pair of electrodes to measure moisture based on changes in resistance in response to a content of moisture.

Here, the first and second suction ducts 130 and 140 have been illustrated as physically separated two structures, but the present disclosure may regard an example that the two ducts are integrally formed, without being limited to the two structures.

Here, the first suction duct 130 may allow external air to be introduced thereinto via a suction port (not shown) formed at the main body 102. The introduced external air may be heat up into hot air by the heater 150 so as to flow into the drum 120. The air flowed into the drum 120 may then dry the clothes and thereafter be introduced into a front duct 160 located below the front surface of the drum 120.

The air introduced into the front duct 160 may contain foreign materials, such as lint or dust existing on surfaces of the clothes. Accordingly, a lint filter 162 for filtering off the foreign materials may be installed within the front duct 160. Consequently, the foreign materials may be filtered off from the introduced air via the lint filter 162.

An exhaust duct 180 may be connected to the front duct 160. The first exhaust duct 180 may define a part of an exhaust channel for discharging hot air passed through the front duct 160 to the outside of the main body 102. A blowing fan 170 may be installed within the first exhaust duct 180. The blowing fan 170 may suck air within the drum 120 to forcibly blow out of the dryer.

The blowing fan 170 may be driven by a separate motor from the driving motor. Hence, the blowing fan 170 and the drum 120 may be independently rotatable. The driving motor for driving the drum 120 may include an inverter control circuit for control of a rotating direction and speed of the drum 120. Here, the inverter control circuit may include a specific controller.

The rear end of the first exhaust duct 180 may be shown having a second exhaust duct 190. An end portion of the second exhaust duct 190 may communicate with the outside of the main body 102 to act as an exhaust port. Hence, the first and second exhaust ducts 180 and 190 and the communicating portion may define an exhaust channel. Consequently, air introduced via the first suction duct 130 may flow sequentially via the second suction duct 140, the drum 120, the front duct 160, the first exhaust duct 180 and the second exhaust duct 190, thereby being discharged out of the main body 102. Here, the second exhaust duct 190 may include a duct connected to the outside of a space in which the exemplary embodiment is installed so as to directly discharge exhaust gas to the outside. A heat exchanger may be installed in the second exhaust duct 190 so as to cool and condense exhaust gas, thereby discharging to the inside.

Figure 4:
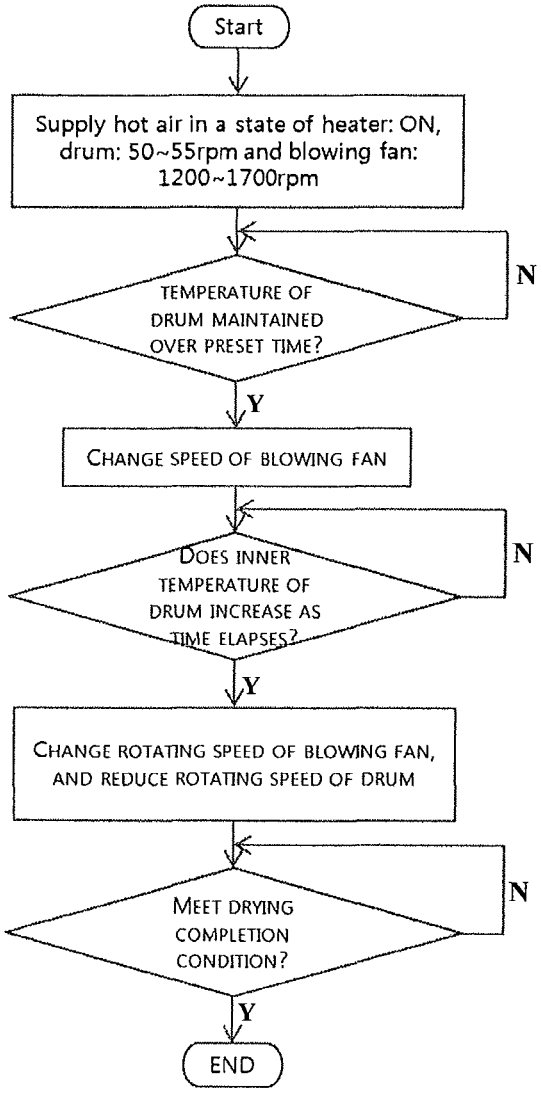
FIG. 4 is a flowchart showing a drying process in the exemplary embodiment of FIG. 1.

Hereinafter, description will be given of a drying process in accordance with the exemplary embodiment with reference to FIG. 4. Once drying is started, power is supplied to the heater to activate the heater and simultaneously the blowing fan and the drum are rotated. Here, the blowing fan may be rotated at speed of about 1200 to 170 rpm, and the drum may be rotated at speed of about 50 to 55 rpm. Such numerical values may be randomly set by a person skilled in the art according to the configuration of a dryer or a quantity of clothes introduced.

Figure 5:
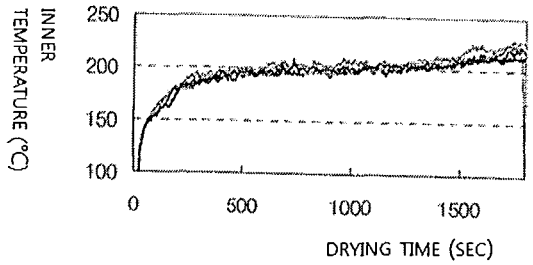
FIG. 5 is a graph showing changes in an inner temperature of a drum according to a time lapse during the drying process in the exemplary embodiment of FIG. 1.
Figure 6:
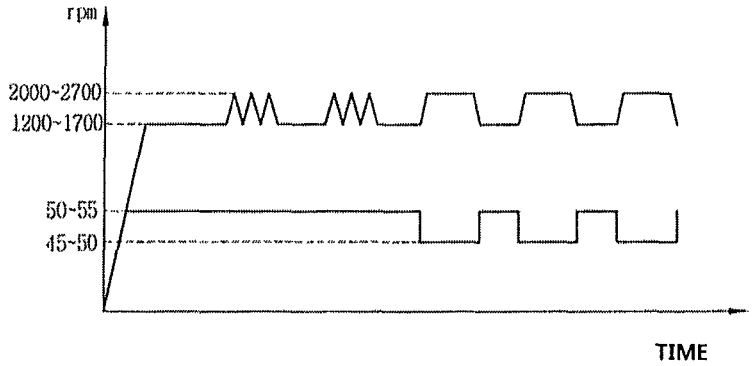
FIG. 6 is a graph showing changes in rotation speeds of a blowing fan and a drum according to a time lapse in the exemplary embodiment of FIG. 1.

Upon supplying hot air into the drum, moisture contained in the clothes is evaporated by the hot air such that the clothes cam be dried. FIG. 5 is a graph showing changes in an inner temperature of the drum according to a time lapse during the drying process. As shown in FIG. 5, an inner temperature of the drum increases within a relatively low range due to a large quantity of moisture at the beginning of the drying process, but is constantly maintained at an approximately 200° C. in the middle of the drying for which the quantity of heat contained in the hot air and heat of evaporation generated due to moisture evaporation are balanced with each other. Afterwards, as a moisture content of the clothes is lowered, the quantity of heat contained in the hot air is relatively increased, which results in a gradual increase in the inner temperature of the drum.

Therefore, in accordance with the exemplary embodiment, the changes in the inner temperature of the drum are detected. When the inner temperature is constantly maintained over a predetermined time, it is determined that the drying process is in a middle part, thereby changing a rotating speed of the blowing fan. The process of changing the rotating speed may be carried out by repeating three times a process of accelerating the blowing fan from the speed of 1200 to 1700 rpm to a higher level, namely, a speed of 2000 to 2700 rpm and then decelerating the blowing fan back to the original speed. Here, if the three-time repetition of the acceleration and deceleration is performed as one set, totally two sets of the repetition are carried out with a preset time interval during the middle part of the drying process.

The acceleration and deceleration may allow for the change in the air flow rate supplied into the drum. This may change air pressure applied to the clothes, which allows the clothes, which are in an entangled state and pressed onto an inner wall of the drum, to be free from other clothes and the inner wall of the drum. Consequently, a contact area between the clothes and the hot air can increase to raise a drying speed and reduce wrinkles generated on the clothes.

Afterwards, when the inner temperature of the drum increases as a time elapses, it means the drying process is approaching to the last part. In this case, the rotating speed of the blowing fan increases. Here, this state is maintained for about 3 to 5 minutes, and then the speed is decelerated. This process is repeated totally three times. When the rotating speed of the blowing fan increases, the rotating speed of the drum is decelerated to 45 to 45 rpm. During the last part of the drying process, the clothes become light due to decrease of moisture. Hence, upon supplying a large air flow rate, the clothes may rotate more actively. Here, when the high rotating speed of the drum is maintained, the clothes are closely adhered onto the inner wall of the drum due to a centrifugal force, thereby increasing friction due to air pressure. Therefore, the rotating speed of the drum may be reduced to prevent the increase in the friction and also facilitate separating of the clothes from the inner wall of the drum.

Especially, when the rotating speed of the drum is reduced and the air flow rate increases at the last part of the drying process, the dropped clothes may be temporarily floated in the air by air pressure, which may derive advantageous conditions in aspects of friction decrease and wrinkle removal. In addition, the rotating speeds of the drum and the blowing fan are repeatedly accelerated and decelerated, so the clothes can move or rotate more actively within the drum.

When air of high volume is supplied during the last part of the drying process, a temperature of hot air supplied may be decreased due to the fixed quantity of heat from the heater. Accordingly, the drying is carried out at low temperature, which may allow generated winkles to become smooth other than being fixed, thereby minimizing generation of winkles. While repeating such process, a moisture content within the clothes is measured. When the measurement meets a drying completion condition, the drying process may be ended.

Especially, even if hot air of high temperature is supplied during the last part of the drying process, a quantity of heat, which is contained in the hot air but exhausted to the outside without being used, increases due to a less content of moisture within the clothes. Hence, it is important to control an air flow rate by rapidly checking whether the drying process is approaching to the last part. In general, a great temperature deviation according to a measuring position is exhibited due to the rotation of the clothes within the drum and an irregular air flow rate, so an accurate measurement is not easy to be performed.

Accordingly, an example may be considered in which the inner temperature of the drum is not directly measured but other parameters are measured to indirectly judge the inner temperature of the drum. One of those parameters may be a temperature of air exhausted from the drum. That is, when air within the drum is exhausted out of the drum via the exhaust duct, since an area of the exhaust duct is smaller than the drum, it may be possible to measure a relatively accurately temperature. Hence, if the temperature of the exhausted air is measured and the changes in the temperature are observed, it may be possible to check to which level the drying process has been done, namely, to which part the drying process corresponds among the beginning, middle, and last parts.

Another parameter may be a moisture content within the clothes. Besides, the heater may be configured to be blocked from power supply for prevention of overheat according to the inner temperature of the drum. The frequency of blocking the power supply may also be used as a parameter for indirectly judging the inner temperature of the drum.

In the meantime, for prevention of winkle generation, a time, for which the clothes bump against the inner wall of the drum at the last part of the drying process, in detail, at a time point when the moisture content is about 7 to 10%, may be made as short as possible. As described above, the clothes are lifted to the upper portion of the drum by a lifter installed at the inner wall of the drum in response to the rotation of the drum and thereafter dropped onto the bottom of the drum by the gravity. This process has been revealed as one of causes of generating winkles according to experimental results. Hence, in order to prevent this, it is necessary to minimize a time for which the clothes bump against the inner wall of the drum. An operating method therefor is shown in FIG. 7.

Figure 7:
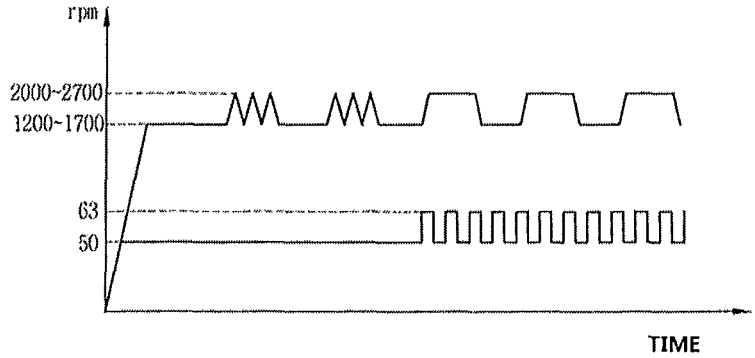
FIG. 7 is a graph showing changes in the rotation speed of the drum in another drying process in the exemplary embodiment of FIG. 1.

FIG. 7 is a graph showing the changes in the rotating speed of the drum at the last part of the drying process, in detail, at the time point when the moisture content is about 7 to 10%. As shown in FIG. 7, the drum is being accelerated and decelerated to 63 rpm and 50 rpm per 2 seconds. When the drum is accelerated from 50 rpm to 63 rpm, the clothes are closely adhered onto the inner wall of the drum due to an increase in a centrifugal force, which makes the clothes moved together with the drum so as to be lifted. Afterwards, when the drum is decelerated, the contact force between the clothes and the drum is reduced due to the decrease of the centrifugal force. Accordingly, some clothes are dropped down. However, the clothes may not be immediately dropped onto the bottom but floated in the air for a preset time, which may result in minimization of a collision time of the clothes against the inner wall of the drum.

In order to increase the floating time in the air, as aforementioned, the blowing fan may be rotated with a relatively large air flow rate, for example, at speed of 2000 to 2700 rpm, during the acceleration and deceleration section, as compared to the normal state.

The foregoing embodiments and advantages are merely exemplary and are not to be construed as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A method for operating a clothes treating apparatus comprising a hot air supplying unit provided with a heater and a blowing fan, and having a drying function of drying clothes by supplying hot air into a drum by use of the hot air supplying unit, the method comprising:

rotating the drum at a first speed with the clothes introduced therein;

supplying hot air into the drum by rotating the blowing fan at a first speed while the drum is rotated; and changing an air flow rate supplied by the blowing fan during the hot air supplying step, wherein the hot air supplying step comprises:

a first drying step of increasing an inner temperature of the drum;

a second drying step of constantly maintaining the inner temperature of the drum after the first drying step; and a third drying step of re-increasing the inner temperature of the drum after the second drying step, wherein the second drying step comprises changing the rotating speed by repeating a plurality of times a process of accelerating the blowing fan from the first speed to a higher level of a second speed than that of the first speed and then decelerating the blowing fan back to the original speed, without stopping the blowing fan, wherein the third drying step comprises:

increasing the rotating speed of the blowing fan to the second speed, maintaining the second speed of the blowing fan for a preset time; and decreasing the rotation speed of the blowing fan to the first speed;

wherein the increasing, maintaining and decreasing is a plurality of times repeated, and wherein the rotating speed of the drum is decelerated in a preset direction to a lower level of a second speed than that of the first speed of the drum, when the rotating speed of the blowing fan increases.

2. The method of claim 1, wherein the hot air supplying step comprises:

measuring temperature of hot air exhausted from the drum; and increasing the air flow rate when the measured temperature of the exhausted air exceeds a predetermined temperature.

3. The method of claim 1, wherein the hot air supplying step comprises:

measuring a moisture content within the clothes introduced into the drum; and increasing the air flow rate when the measured moisture content is less than a predetermined level.

4. The method of claim 1, wherein the third drying step comprises accelerating and decelerating the rotation speed of the drum in an alternating manner at a predetermined time interval.

5. The method of claim 1, wherein the heater is configured to be blocked from power supply when an inner temperature of the drum increases more than a predetermined level, wherein the hot air supplying step further comprises:

measuring a frequency of blocking the power supply to the heater; and increasing the air flow rate when the measured frequency of blocking the power supply is more than a predetermined level.

6. The method of claim 1, wherein the drum is provided with a suction duct which sucks the air into the drum, the suction duct having an inlet portion which is communicated with a rear surface of the drum and the inlet portion extends in a height direction of the drum from an upper portion of the rear surface of the drum to a lower portion of the rear surface of the drum.

* * * * *